US005553850A

United States Patent [19]

Savu et al.

[11] Patent Number: 5,553,850

[45] Date of Patent: Sep. 10, 1996

[54] GOLFING GAME DART BOARD, GOLFING DART GAME AND AN ASSOCIATED METHOD

[75] Inventors: Jeffrey L. Savu; Timothy Tarcha, both of Butler, Pa.

[73] Assignee: Adventure In Mind, Inc., Butler, Pa.

[21] Appl. No.: 462,785

[22] Filed: Jun. 5, 1995

[51] Int. Cl.[6] ..... F41J 3/00; A63F 7/06

[52] U.S. Cl. ..... 273/317.2; 273/408; 273/409

[58] Field of Search ..... 273/407, 408, 273/409, 416, 317, 87 R, 87 A, 244, 259, 277; D21/5, 6; 473/131

[56] References Cited

U.S. PATENT DOCUMENTS 3,697,073 10/1972 Dooley .
4,949,977 8/1990 Smith .
4,974,857 12/1990 Beall .
5,020,807 6/1991 Barkley .
5,197,743 3/1993 Hanson, Jr. .

*Primary Examiner*—Sebastiano Passaniti
*Attorney, Agent, or Firm*—David V. Radack; Eckert Seamans Cherin & Mellott

[57] ABSTRACT

A golfing game dart board including a plurality of landing zones having distance indicia thereon which correspond to distance indicia on a plurality of floor markers spaced from the golfing game dart board. An associated golfing dart game and a method of playing a golfing dart game are also disclosed.

20 Claims, 4 Drawing Sheets

GOLFING GAME DART BOARD, GOLFING DART GAME AND AN ASSOCIATED METHOD

BACKGROUND OF THE INVENTION

This invention relates to a golfing game dart board, a golfing dart game and an associated method and more particularly to a game which combines golf and darts whereby the distance a player must stand away from the dart board is determined by the results of a previous throw.

Darts is a well-known, time-tested game of skill in which a player throws a projectile having a sharp end ("dart") at a dart board, usually made of cork. The traditional dart board is circular and is divided into twenty sections numbered one through twenty. There are also two concentric circles disposed in the middle of the dart board. There are many different games that can be played with this dart board.

Beyond the traditional dart board, there are other dart games which combine other games, such as golf, with darts. For example, U.S. Pat. No. 5,197,743 discloses a dart game having a plurality of golf holes indicated thereon. U.S. Pat. No. 3,697,073 discloses a projection system in association with a golfing dart board game. The frames of the projection change with each throw. This dart game requires very specialized equipment and thus is not feasible for a wide range of users.

What is needed is a golfing darts game that does not require expensive equipment and which is fun, unique and easy to learn.

SUMMARY OF THE INVENTION

The invention has met the above need. A golfing game dart board is provided which includes a plurality of zones having distance indicia thereon which correspond to distance indicia on a plurality of floor markers spaced from the golfing game dart board. The distance from which a dart is thrown is determined by the results of a previous throw. The invention also provides a golfing dart game including a golfing game dart board having a plurality of zones with indicia thereon and a plurality of floor markers spaced from the golfing game dart board. The floor markers have distance indicia corresponding to the distance indicia on the zones.

An associated method of playing a golfing dart game is also provided wherein a dart is thrown at a dart board and then subsequently thrown again at the dart board from a distance determined by the results of the first throw. An entire round of golfing darts consisting of eighteen holes, including par-3's, par-4's and par-5's, can be played in accordance with this method.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
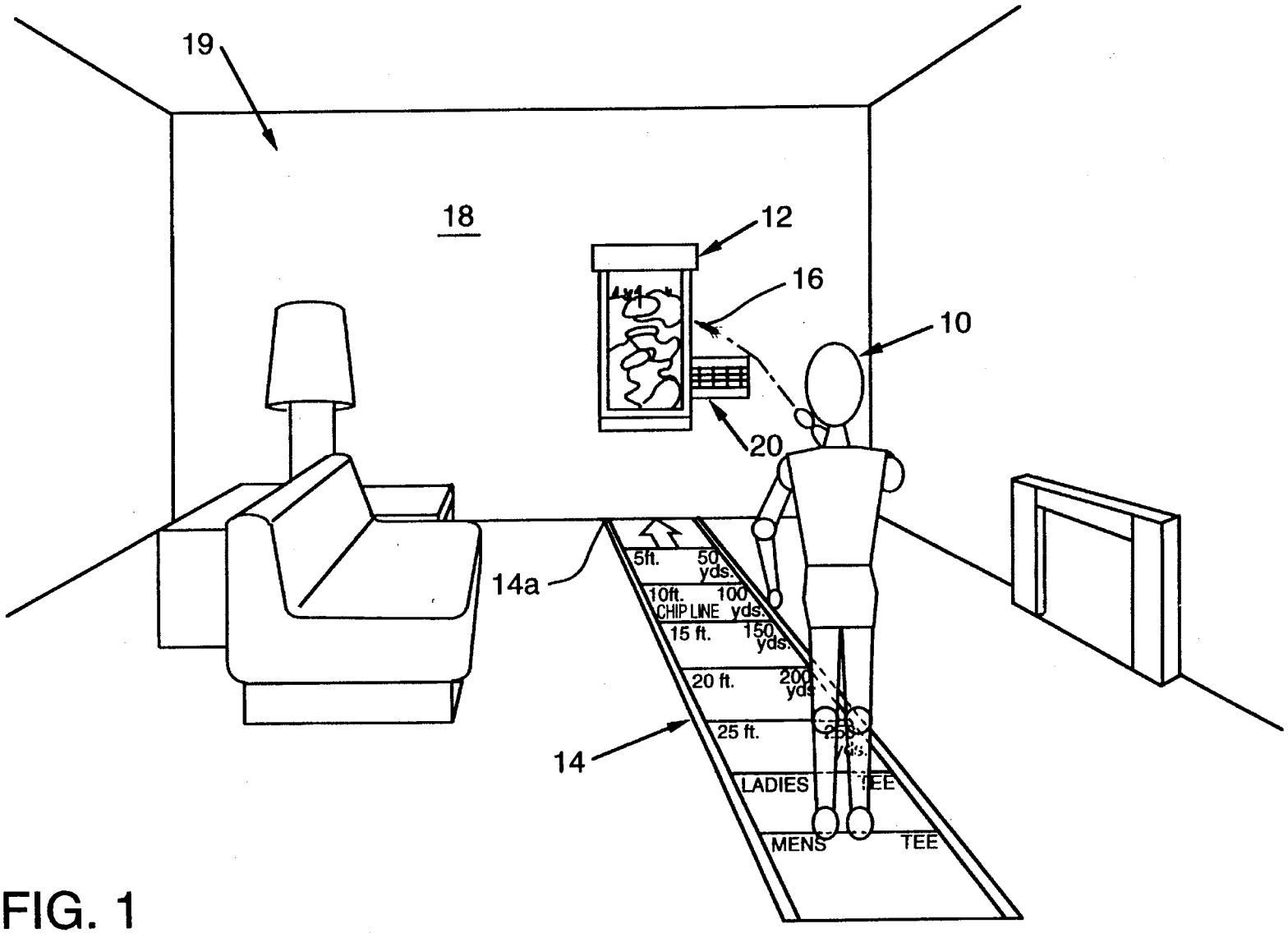
FIG. 1 is a perspective view showing the golfing dart game being played by a player in a room.

Referring to FIG. 1, a player 10 playing the golfing dart game of the invention is shown. The game is played with a dart board 12, a floor mat 14 and at least one dart 16, although it will be appreciated that more than one dart (usually three) can be provided per player. The dart board 12 is hung on the wall 18 of the room 19 in which the game is played. The floor mat 14 is then positioned with one edge 14*a* against the wall 18 and then rolled out away from the wall 18.

Figure 2:
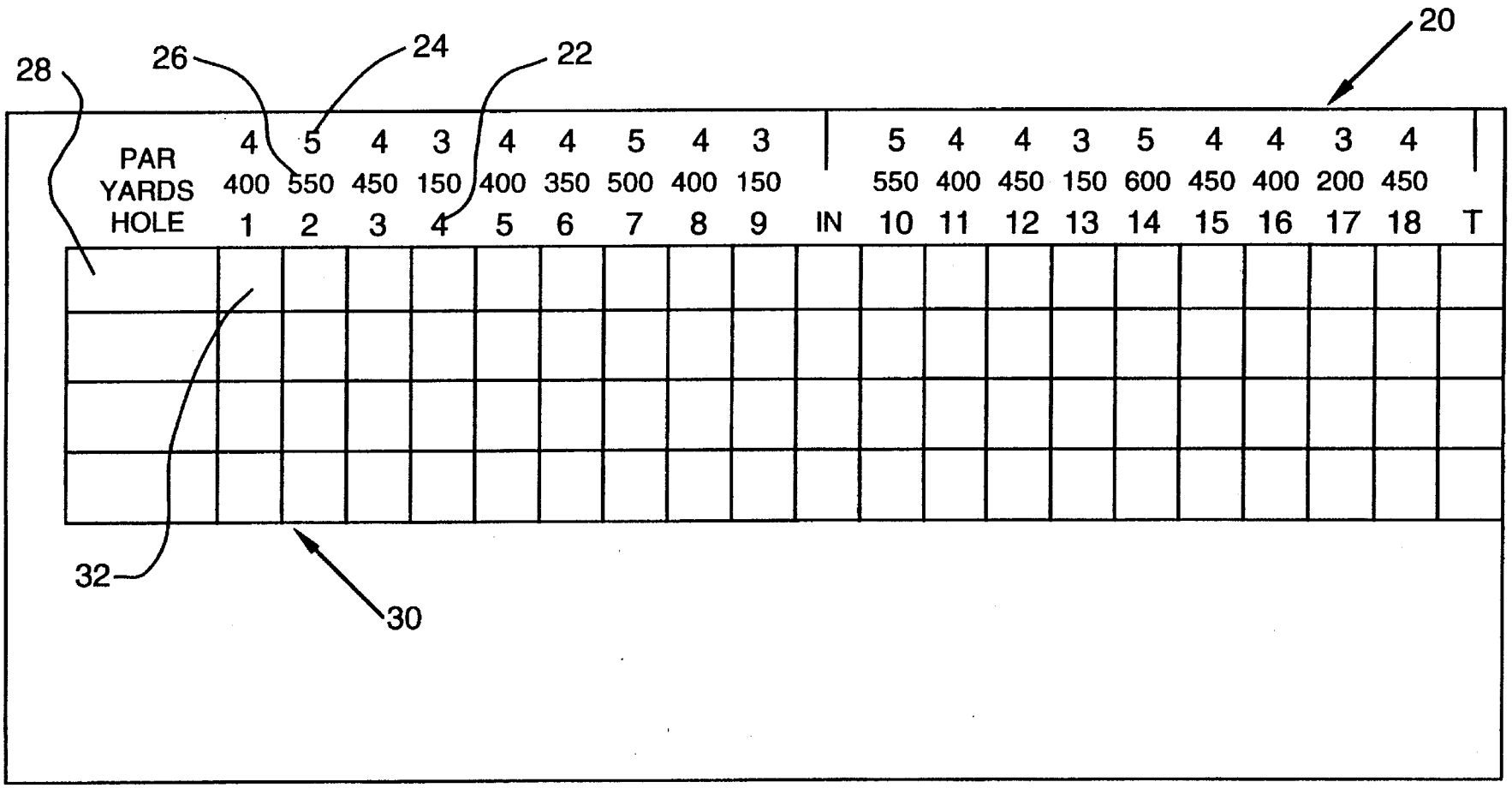
FIG. 2 is a front elevational view of a scoreboard used in the game.

The golfing dart game of the invention, like regular golf, can be played alone or with other players. In order to keep track of the scores of the players, a scoreboard 20 is also provided. Referring to FIG. 2, the scoreboard 20 is in the form of a golf scorecard, which lists eighteen holes such as hole no. 1 (reference no. 22), the par of each hole such as par 4 for hole no. 1 (reference no. 24) and the yardage of each hole such as 400 yards for hole no. 1 (reference no. 26). The scorecard 20 also has spaces 28 for listing each player's name and a grid 30 having individual blocks, such as block 32 for entering the score of a player for that particular hole, in this case hole no. 1. The scorecard 20 is preferably designed so that the par and yardages can be changed, as by erasing, so that different "golf courses" can be created. Thus, the scoreboard can be a chalkboard, "whiteboard" or even an electronic device, as will be discussed below.

Figure 3:
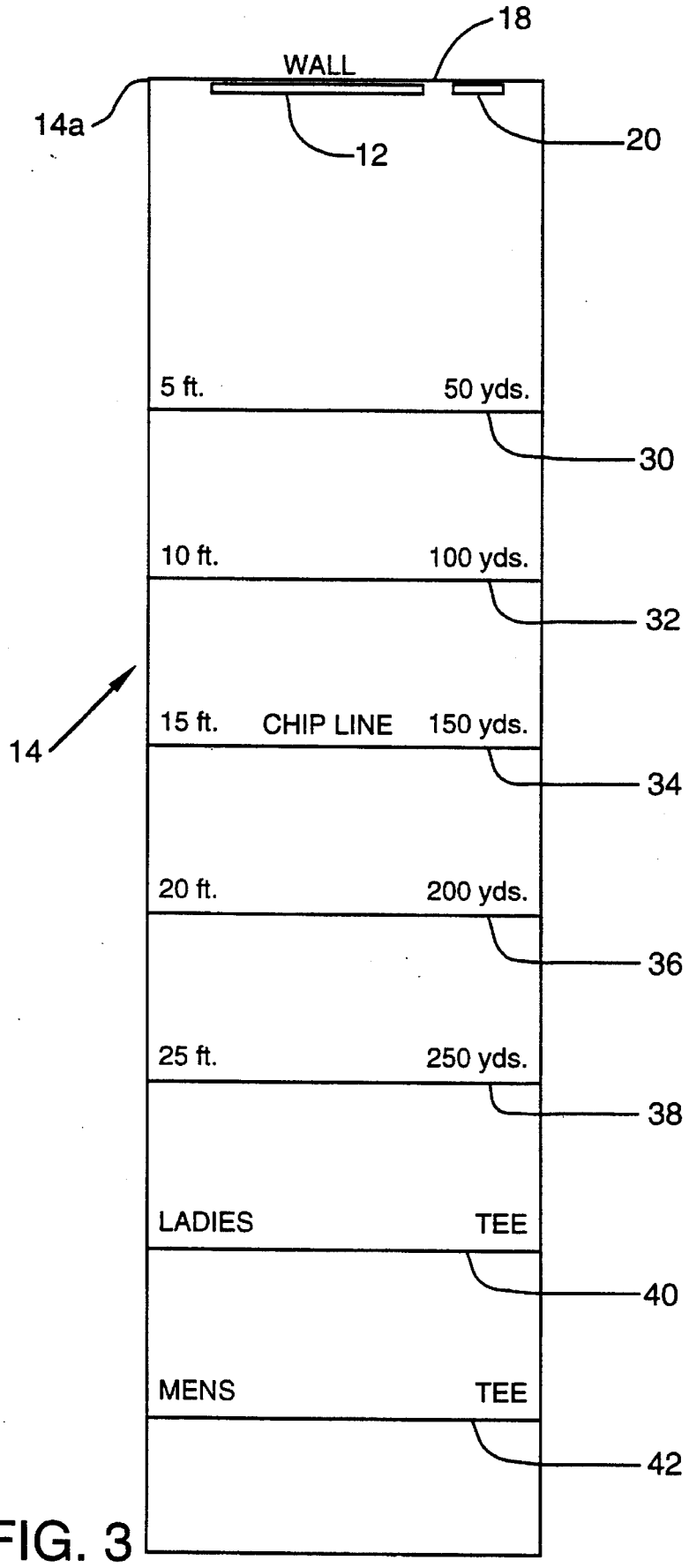
FIG. 3 is a top plan view of the floor mat.

Referring now to FIG. 3, the floor mat 14 of the invention will be discussed. The floor mat 14, which is preferably a green carpet (to simulate the "feel" of a golf course) is divided into zones by floor markers such as lines 30, 32, 34, 36, 38, 40 and 42. Lines 30, 32, 34, 36 and 38 are provided with two sets of distance markings. The first distance marking, on the left side, is indication of a distance in feet and the second distance marking, on the right side, is indication of a distance in yards. As will be explained further below, the feet markings correspond to distances for putts and the yardage markings correspond to distances for other shots. For example, line 36 is the line for a twenty-foot putt and a two-hundred yard fairway shot. Lines 40 and 42 are lines for the ladies' tee and men's tee, respectively.

Figure 4:
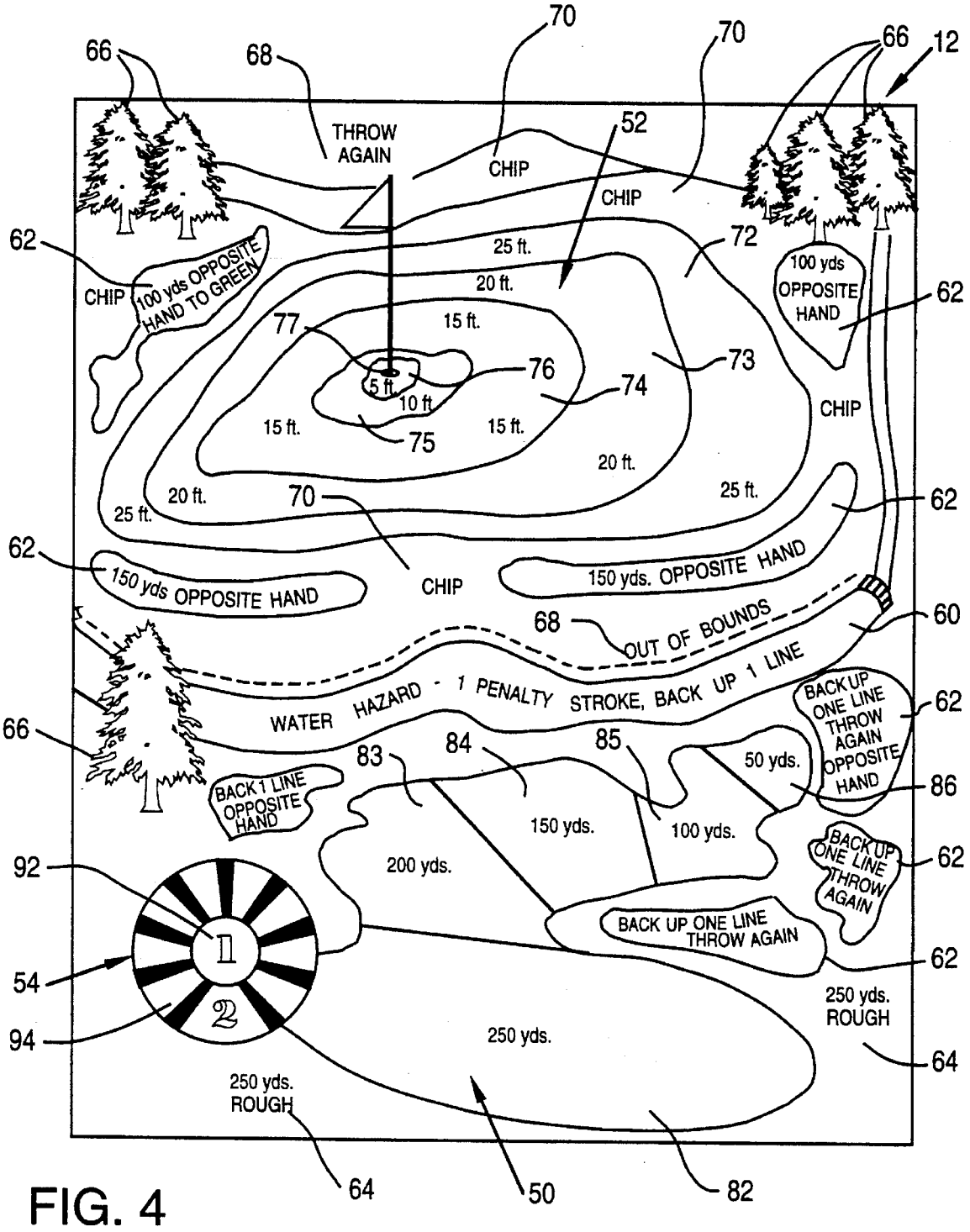
FIG. 4 is a front elevational view of the golf game dart board.

FIG. 4 shows a front elevational view of the dart board 12. The dart board 12 has a plurality of landing zones, some of which have distance indicia thereon. The distance indicia corresponds to the marking indicia on the floor mat 14, as will be explained below. There are three main landing zones, the fairway landing zone 50, the green landing zone 52 and the hole landing zone 54. These landing zones are surrounded by a full complement of hazard landing zones, such as water hazard zones 60, bunker zones 62, rough zones 64, tree zones 66, out of bounds zones 68 and chip zones 70. A dart landing in one of these zones means that the player is penalized by: having to throw from a same or different floor marker; adding a penalty stroke; and/or making the next throw with the player's opposite hand, as is indicated on the dart board. The green landing zone 52 is further subdivided into six subzones: the 25 ft. subzone 72; the 20 ft. subzone 73; the 15 ft. subzone 74; the 10 ft. subzone 75, the 5 ft. subzone 76; and the hole subzone 77. The fairway landing zone 50 is subdivided into five subzones: the 250 yd. subzone 82; the 200 yd. subzone 83; the 150 yd. subzone 84; the 100 yd. subzone 85; and the 50 yd. subzone 86.

Now that the dart board 12, floor mat 14 and scorecard 20 have been explained, the rules of play of the golfing darts game will be set forth below. As was mentioned above, a player can "create" a golf course by assigning yardages and a par to each hole. Referring to FIG. 2, the player's first hole is a par 4, 400 yards. Because this hole is a par 4, the player stands behind the men's tee (assume a male player 10) and throws his dart 16 at the fairway landing zone 50. The player 10 must land his dart in the fairway landing zone 50 before shooting for the green landing zone 52. If the player misses landing his dart into the fairway landing zone 50, he must try again (and add a penalty if, for example, his dart lands in the water hazard zone 60). Each throw of the dart counts as a "stroke", just as in the game of golf Penalty strokes are added as indicated on the dart board 12.

Assume that in this example the player lands his dart into the fairway landing zone 50, and more particularly into the 150 yd. subzone 84. Because this is a par 4, the player can now shoot for the green landing zone 52. By virtue of landing in the 150 yd. subzone 84, the player's next throw ("stroke") is from line 34 on the floor mat 14, which is the line that indicates the 150 yd. "distance". If, for example, the player 10 hits the 100 yd. subzone 85 with his first throw, the player 10 could move to the closer line 32 which indicates the 100 yd. distance. It will be appreciated that the closer a player is to the dart board, the more accurate the player's throw can be. However, the dart board 12 is designed to place more risk on trying to hit the smaller fairway subzones, such as the 50 yd. subzone 86 and the 100 yd. subzone 85, as opposed to the larger 200 yd. subzone 83 and 250 yd. subzone 82.

Thus, the main idea of the invention is providing a golfing darts game in which the distance from which the player throws his next dart is determined by the results of the previous throw.

Returning to player 10's game, player 10's first dart landed in the 150 yd. subzone 84. The player now stands behind line 34 and throws towards the green landing zone 52. Assume that the player's second throw ("stroke") lands in the 20 ft. subzone 73. Of course, if the player does not reach the green landing zone 52, the player will incur the indicated penalty. If the player's dart lands in one of the chip subzones 70, the player must stand behind the chip line, line 34 (FIG. 3) and then take another throw to reach the green landing zone 52.

Player 10 has hit the 20 ft. landing subzone 73. In this case, the player moves to line 36, which indicates a 20 ft. putt, and then throws his third dart ("third stroke") at the hole landing zone 54, which is divided into a one-putt subzone 92 and a two-putt subzone 94. If the player lands his dart in the one-putt subzone 92, the player's score on the first hole is a birdie 3 (first shot in the fairway 150 yd. subzone 84; second shot in the green 20 ft. subzone 73 and third shot in the one-putt subzone 92 for a total of three strokes). Of course, if the player lands his dart in the two-putt subzone 94, the player scores a par 4. If the player lands his dart outside the hole zone 54, this is considered a three-putt, and the player scores a bogey 5.

The player then continues to play the second hole, this hole being a par 5. Once again the player starts from the men's tee and throws toward the fairway zone 50. Assume the player's first throw lands in the 250 yd. subzone 82. Because this is a par 5, the player must again hit the fairway zone 50, however the player throws his second dart from line 38 (FIG. 3) indicating 250 yds. Assume the player then lands his second dart in the 150 yd. subzone 84. Play on the hole will continue as with the first par 4 hole.

For a par 3 hole, such as the fourth hole on the scorecard, the player's first throw will be aimed at the green zone 52 from the distance indicated on the scorecard. For example, number four is a 150 yd. par 3. Thus, the player's first throw will be from line 34 and will be thrown towards the green zone 52. Play on this hole will continue as was discussed above.

In order to keep better track of a player's score on a hole, a plurality of darts, say ten, can be provided, each dart being numbered one through ten. A player's first throw is made with the dart numbered one, the second throw made with the dart numbered two and so on until completion of the hole. If a penalty stroke is incurred, a numbered dart can be skipped. As an alternative to providing numbered darts a numbered feather can be placed on an existing dart.

It will be appreciated that the game will continue until as many holes as a player wishes to play are played. For example, a player may want to play nine or eighteen holes. Also, it will be appreciated that other players can play. Wagering and other games related to golf, such as match play, nassaus, "presses" etc. can be played.

Although the invention has been disclosed in terms of a cork dart board, a floor mat and a chalkboard scorecard, it will be appreciated that those skilled in the art can substitute different materials and marking indicia methods. For example, the floor mat may not be necessary, all that is needed are markings on the floor in the room in which the game is to be played. These markings can be made by chalk or with tape. Furthermore, the entire game can be electronic, as is known to do in conventional dart games, with automatic electronic scoring and electronic darts.

It will be appreciated that a golfing darts game has been provided which combines the traditional games of darts and golf into a unique, fast moving and easy to learn game.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A golfing game dart board including a plurality of landing zones having distance indicia thereon which correspond to distance indicia on a plurality of floor markers spaced from said golfing game dart board.

2. The golfing game dart board of claim 1, wherein said landing zones include a fairway landing zone and a green landing zone, said fairway landing zone and said green landing zone each being divided into a plurality of subzones, each of said subzones including a unique distance indicia thereon.

3. The golfing game dart board of claim 2, wherein each of said floor markers include two distance indicias, one of said distance indicia for said floor marker corresponds to said distance indicia of said subzones of said fairway landing zone and the other of said distance indicia for said floor marker corresponds to said distance indicia of said subzones of said green landing zone.

4. The golfing game dart board of claim 3, wherein said landing zones include a hole landing zone which is divided into a one-putt subzone and a two-putt subzone.

5. The golfing game dart board of claim 4, wherein said landing zones include a chip shot landing zone.

6. The golfing game dart board of claim 5, wherein said landing zones include a plurality of hazard landing zones.

7. A golfing dart game comprising:

a golfing game dart board having a plurality of landing zones with distance indicia thereon; and a plurality of floor markers spaced from said golfing game dart board, said floor markers having distance indicia corresponding to said distance indicia on said landing zones.

8. The golfing dart game of claim 7, wherein said landing zones include a fairway landing zone and a green landing zone, said fairway landing zone and said green landing zone each being divided into a plurality of subzones, each of said subzones including a unique distance indicia thereon.

9. The golfing dart game of claim 8, wherein each of said floor markers include two distance indicias, one of said distance indicia for said floor marker corresponds to said distance indicia of said subzones of said fairway landing zone and the other of said distance indicia for said floor marker corresponds to said distance indicia of said subzones of said green landing zone.

10. The golfing dart game of claim 7, wherein a floor mat having disposed thereon said floor markers.

11. A method of playing a golfing dart game comprising:

providing a dart board and a dart;

providing a plurality of landing zones on said dart board; providing a plurality of floor markers spaced from said dart board; said landing zones having distance indicia thereon which correspond to distance indicia on said floor markers;

throwing said dart at said dart board; and subsequently throwing said dart again at said dart board from a distance determined by the results of said first throw of said dart at said dart board.

12. The method of claim 11, including throwing said dart so that said dart lands into one of said landing zones; and subsequently throwing said dart from said distance determined by said landing zone into which said dart has landed after said first throw.

13. The method of claim 12, including each floor marker being a different actual distance away from said dart board.

14. The method of claim 13, wherein whereby said dart is subsequently thrown from behind one of said floor markers based on said landing zone into which said dart landed after said first throw.

15. The method of claim 14, wherein providing said dart board with a fairway landing zone and a green landing zone, said fairway landing zone and said green landing zone each being divided into a plurality of subzones, each of said subzones including a unique distance indicia thereon;

providing a hole landing zone which is divided into a one-putt subzone and a two-putt subzone; and providing two said distance indicias on each of said floor markers, one of said distance indicia for said floor marker corresponding to said distance indicia of said subzones of said fairway landing zone and the other of said distance indicia for said floor marker corresponding to said distance indicia of said subzones of said green landing zone.

16. The method of claim 15, including playing a par 3 hole of said golfing dart game by throwing said dart at said green landing zone from behind said floor marker having distance indicia commensurate with an imaginary distance of said par 3 hole, and if successful in hitting one of said subzones of said green landing zone, subsequently throwing said dart at said hole landing zone from behind said floor marker corresponding to said green subzone in which said dart has landed after said first throw, whereby a score on said par 3 hole is determined by adding one to the results of said throw of said dart at said hole landing zone.

17. The method of claim 16, including playing a par 4 hole of said golfing dart game by throwing said dart from a tee-marking at said fairway landing zone and, if successful in hitting one of said subzones of said fairway landing zone, subsequently throwing said dart at said green landing zone from behind said floor marker corresponding to said fairway subzone in which said dart has landed after said first throw, and if successful in hitting one of said subzones of said green landing zone, subsequently throwing said dart at said hole landing zone from behind said floor marker corresponding to said green subzone in which said dart has landed after said second throw, whereby a score on said par 4 hole is determined by adding two to the results of said throw of said dart at said hole landing zone.

18. The method of claim 17, including playing a par 5 hole of said golfing dart game by throwing said dart from a tee-marking at said fairway landing zone and, if successful in hitting one of said subzones of said fairway landing zone, subsequently throwing said dart again at said fairway landing zone from behind said floor marker corresponding to said fairway subzone in which said dart has landed after said first throw and then, if successful again in hitting one of said subzones of said fairway landing zone, subsequently throwing said dart at said green landing zone from behind said floor marker corresponding to said fairway subzone in which said dart has landed after said second throw and, if successful in hitting one of said subzones of said green landing zone, subsequently throwing said dart at said hole landing zone from behind said floor marker corresponding to said green subzone in which said dart has landed after said third throw, whereby a score and said par 5 hole is determined by adding three to the results of said throw of said dart at said hole landing zone.

19. The method of claim 16, including providing said game board with a plurality of hazard landing zones separate from said green landing zone and said fairway landing zone, whereby when said dart lands in said hazard landing zone, said player is penalized by either having to throw from a same or different said floor marker again, adding a penalty stroke to said player's score, or making the next said throw with said player's opposite hand and whereby every throw counts as one stroke in determining a player's score on said hole.

20. The method of claim 19, including providing a chip landing zone disposed adjacent said green landing zone and a corresponding floor marker, whereby throws towards said green landing zone, which miss said green landing zone and land in said chip landing zone mean that said player must subsequently throw from behind said chip landing zone floor marker towards said green landing zone and count said throw as one stroke towards said player's score.

* * * * *